US012270225B1

(12) United States Patent
Wang

(10) Patent No.: US 12,270,225 B1
(45) Date of Patent: Apr. 8, 2025

(54) UNDERWATER ROBOT

(71) Applicant: Wencui Wang, Yichun (CN)

(72) Inventor: Wencui Wang, Yichun (CN)

( * ) Notice: Subject to any disclaimer, the term of this patent is extended or adjusted under 35 U.S.C. 154(b) by 0 days.

(21) Appl. No.: 18/933,909

(22) Filed: Oct. 31, 2024

(30) Foreign Application Priority Data

Jan. 12, 2024 (CN) ..... 202420083883.6

(51) Int. Cl.
*E04H 4/16* (2006.01)
*B63G 8/00* (2006.01)
*B63G 8/08* (2006.01)

(52) U.S. Cl.
CPC ..... *E04H 4/1654* (2013.01); *B63G 8/001* (2013.01); *B63G 8/08* (2013.01); *B63G 2008/004* (2013.01); *E04H 4/1636* (2013.01)

(58) Field of Classification Search
CPC ..... E04H 4/16; E04H 4/1636; E04H 4/1654
See application file for complete search history.

(56) References Cited

U.S. PATENT DOCUMENTS

2024/0279951 A1* 8/2024 Wei ..... E04H 4/1654
2024/0310851 A1* 9/2024 Ebrahimi Afrouzi ..... A47L 9/2873

FOREIGN PATENT DOCUMENTS

CN 209758759 U 12/2019
CN 210592347 U 5/2020
CN 212099301 U 12/2020
WO WO-2020224308 A1 * 11/2020 ..... B01D 33/801

* cited by examiner

*Primary Examiner* — Michael D Jennings
(74) *Attorney, Agent, or Firm* — George D. Morgan

(57) ABSTRACT

Provided in the present application is an underwater robot, including a robot body and a trigger mechanism. The trigger mechanism includes a sealed cabin, a driving mechanism, and a sensing structure, where the sealed cabin is disposed in the robot body, and the sensing structure is disposed in the sealed cabin and electrically connected to the driving mechanism. The sensing structure is configured to detect whether the underwater robot enters water, and trigger the driving mechanism to work, so that the underwater robot moves in the water and performs cleaning.

16 Claims, 9 Drawing Sheets

UNDERWATER ROBOT

CROSS-REFERENCE TO RELATED APPLICATIONS

The application claims priority to Chinese patent application No. 2024200838836, filed on Jan. 12, 2024, the entire contents of which are incorporated herein by reference.

TECHNICAL FIELD

The present application relates to the field of swimming pool cleaning, in particular to an underwater robot.

BACKGROUND

At present, with the progress of science and technology, corresponding robots are invented and produced for working in some special environments. For example, underwater robots designed specifically to clean swimming pools are used to scrape and clean dirt in the swimming pools.

Since the underwater robots work under water, it is inconvenient for people outside the pools to control them.

SUMMARY

The present application provides an underwater robot. The underwater robot can work autonomously after entering water, which helps to improve the convenience in cleaning a swimming pool.

An embodiment of the present application provides an underwater robot, configured to clean a bottom of the swimming pool, and including a robot body and a trigger mechanism, where the robot body includes a housing, and the trigger mechanism is disposed in the housing. The trigger mechanism includes a sealed cabin, a driving mechanism, and a sensing structure. The sealed cabin is provided with a sealed cavity and disposed in the housing, where the sealed cavity is sealed. At least part of the structure of the driving mechanism is located in a region between the sealed cabin and the housing. The sensing structure is disposed in the sealed cavity and electrically connected to the driving mechanism. The sensing structure is configured to detect whether the underwater robot enters water, and can trigger the driving mechanism to work, so that the underwater robot moves in the water and/or starts to perform cleaning.

In some embodiments of the present application, wherein the sensing structure include liquid level sensors that are disposed in the sealed cavity and sense whether the underwater robot enters the water without being in contact with the water.

In some embodiments of the present application, wherein the liquid level sensors are closer to a top of the sealed cabin than a bottom of the sealed cabin.

In some embodiments of the present application, wherein the sensing structure include the plurality of liquid level sensors arranged along a vertical direction.

In some embodiments of the present application, wherein the housing has a cavity, and the trigger mechanism is located in the cavity; the housing is provided with a water inlet, a first water outlet, and a second water outlet that communicate with the cavity, and the first water outlet and the second water outlet are formed in two ends of the housing along a front-back direction respectively; after the underwater robot is immersed in the water, the water is capable of entering the cavity from the water inlet; and the driving mechanism is configured to drive the water in the cavity to flow out from the first water outlet or the second water outlet.

In some embodiments of the present application, wherein the driving mechanism include: two motors both electrically connected to the sensing structure, wherein an output shaft of each of the motors hermetically extends out of the sealed cabin; and two impellers both disposed in the region between the sealed cabin and the housing, wherein one of the impellers is connected to the output shaft of one of the motors, and the other impeller is connected to the output shaft of the other motor; and after the underwater robot enters the water and triggers the sensing structure, the sensing structure is configured to trigger one of the motors to work and drive the corresponding impeller to rotate, so that the water in the cavity flows out from the first water outlet or the second water outlet.

In some embodiments of the present application, wherein the robot body further include a baffle that is disposed in the cavity and divides the cavity into an upper cavity and a lower cavity, wherein the upper cavity communicates with the first water outlet and the second water outlet, and the lower cavity communicates with the water inlet; and the baffle is provided with two through holes communicating with the upper cavity and the lower cavity, one of the through holes is opposite to one of the impellers along a vertical direction, and the other through hole is opposite to the other impeller along the vertical direction.

In some embodiments of the present application, wherein the robot body further include a scraper plate rotatably connected to the housing, and at least part of the structure of the scraper plate extends downward from the water inlet; and the scraper plate is configured to scrape up garbage or sundries located below the underwater robot.

In some embodiments of the present application, wherein when the underwater robot moves and performs cleaning, a direction in which the scraper plate extends out from the water inlet is opposite to an advancing direction of the underwater robot.

In some embodiments of the present application, wherein the robot body further include a handle, and part of the structure of the handle is rotatably connected to the housing or the sealed cabin and penetrates through an upper end part of the housing in a manner of extending outwards; the handle has a first state and a second state relative to the housing; when in the first state, the handle is approximately in an upright state; and when in the second state, the handle is inclined relative to the housing.

In some embodiments of the present application, wherein the robot body further include a reset structure connected to the handle and configured to rotate the handle from the second state to the first state; and when the underwater robot is in an underwater working state and the handle rotates from the second state to the first state, the handle triggers the trigger mechanism, and the trigger mechanism acts on the driving mechanism, so that the underwater robot moves in an opposite direction.

In some embodiments of the present application, wherein the trigger mechanism include: a first connecting rod connected to the handle; a second connecting rod connected to the first connecting rod, wherein a connecting region between the second connecting rod and the first connecting rod is rotatably connected to the sealed cabin; a Hall sensor disposed in the sealed cavity, electrically connected to the driving mechanism, and configured to drive motors in the driving mechanism to work; and a magnet connected to an end part of the second connecting rod away from the connecting region; and when rotating relative to the housing, the handle is capable of being connected to the first connecting rod and driving the first connecting rod to rotate, the first connecting rod drives the second connecting rod to rotate, and the second connecting rod drives the magnet to rotate, so that the magnet moves into or out of a sensing region of the Hall sensor.

In some embodiments of the present application, wherein when the handle is in the first state, the magnet is located in the sensing region of the Hall sensor; and when the handle is in the second state, the magnet is located outside the sensing region of the Hall sensor.

In some embodiments of the present application, wherein the trigger mechanism further include a connecting base connected to the handle and provided with a connecting groove, and part of the structure of the first connecting rod is located in the connecting groove; and the handle is capable of rotating to drive the connecting base to rotate, and during rotation of the connecting base, a sidewall of the connecting groove is capable of being connected to the first connecting rod, thereby causing the first connecting rod to rotate.

In some embodiments of the present application, wherein the robot body further include a plurality of traveling wheels disposed at a bottom of the housing.

In some embodiments of the present application, wherein the reset structure include a torsion spring.

In some embodiments of the present application, wherein the robot body further include two cover plates both rotatably connected to the housing, one of the cover plates covers the first water outlet, and the other cover plate covers the second water outlet; when the driving mechanism drives a water flow to flow towards the first water outlet, the water flow jacks up the cover plate covering the first water outlet and flows out from the first water outlet; and when the driving mechanism drives the water flow to flow towards the second water outlet, the water flow jacks up the cover plate covering the second water outlet and flows out from the second water outlet.

After the underwater robot provided by the present application enters the water, the sensing structure can be used to sense whether the underwater robot enters the water and a water entry depth, and can trigger the driving mechanism to work, so that the underwater robot moves in the water and starts to perform cleaning without manual intervention, thereby greatly improving the convenience in cleaning the swimming pool. Moreover, the sensing structure is disposed in the sealed cavity that is sealed, which helps to reduce the impact of water contact on a sealing structure, thereby extending the service life of the sensing structure, and reducing the influence of the service life of the sensing structure on the underwater robot.

BRIEF DESCRIPTION OF DRAWINGS

To more clearly illustrate the technical solutions in the embodiments of the present application, the accompanying drawings that need to be used in the description of the embodiments will be briefly introduced below. Apparently, the accompanying drawings in the description below merely illustrate some embodiments of the present application. Those of ordinary skill in the art may also derive other accompanying drawings from these accompanying drawings without creative efforts.

DESCRIPTION OF REFERENCE SIGNS IN THE DRAWINGS

1. sealed cabin; 11. sealed cavity; 12. cabin body; 13. cabin cover; 2. power supply; 3. driving mechanism; 31. motor; 32. first motor; 33. second motor; 34. impeller; 4. sensing structure; 41. circuit board; 42. liquid level sensor; 5. robot body; 51. cavity; 511. upper cavity; 512. lower cavity; 52. housing; 53. upper housing; 54. lower housing; 541. control switch; 55. water inlet; 56. first water outlet; 57. second water outlet; 58. cover plate; 59. baffle; 591. through hole; 6. scraper plate; 61. traveling wheel; 62. buckle; 7. avoidance hole; 71. handle; 8. reset structure; 9. trigger mechanism; 91. connecting base; 911. connecting groove; 92. first connecting rod; 93. second connecting rod; 94. magnet; and 95. sensing region.

DETAILED DESCRIPTION OF THE EMBODIMENTS

The technical solutions in the embodiments of the present application will be clearly and completely described below with reference to the accompanying drawings in the embodiments of the present application. Apparently, the described embodiments are merely some rather than all of the embodiments of the present application. All other embodiments obtained by those of ordinary skill in the art based on the embodiments in the present application without creative efforts shall fall within the scope of protection of the present application.

Figure 1:
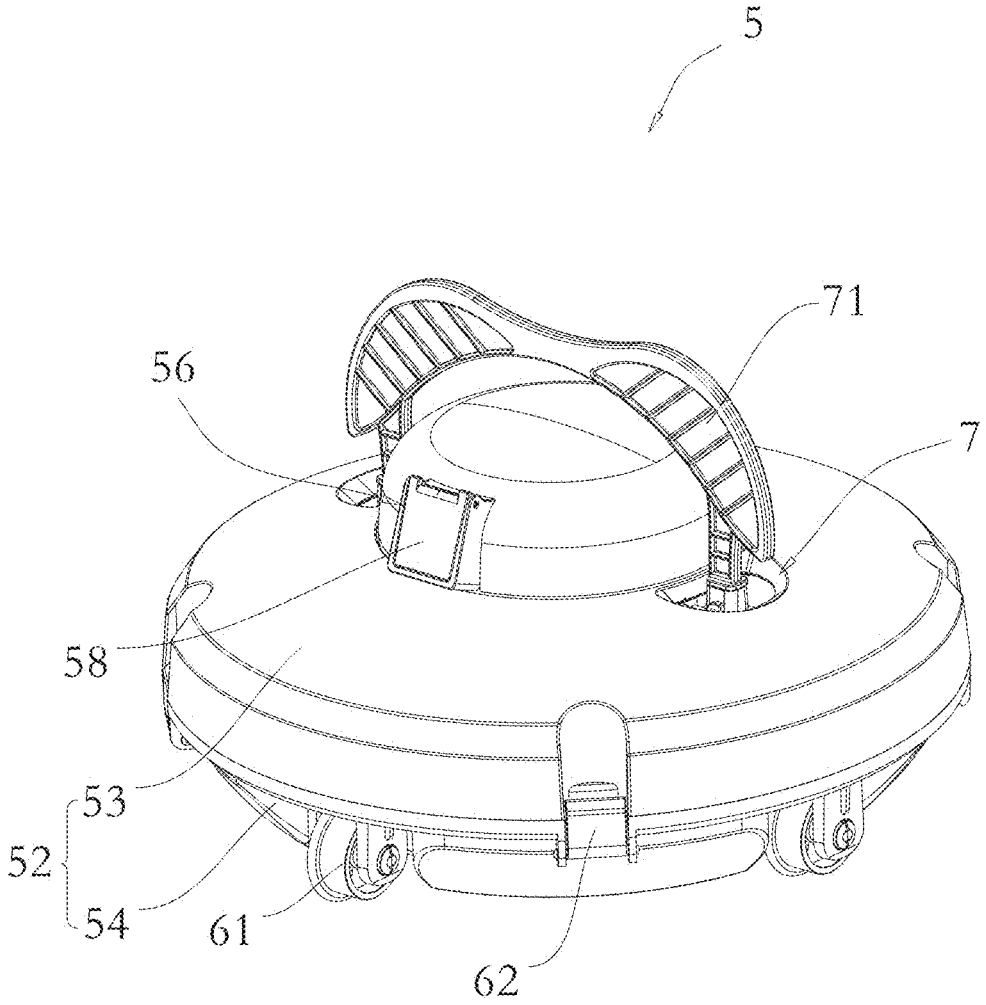
FIG. 1 is a schematic structural diagram of an underwater robot provided in one embodiment of the present application, where a handle is in a first state.
Figure 2:
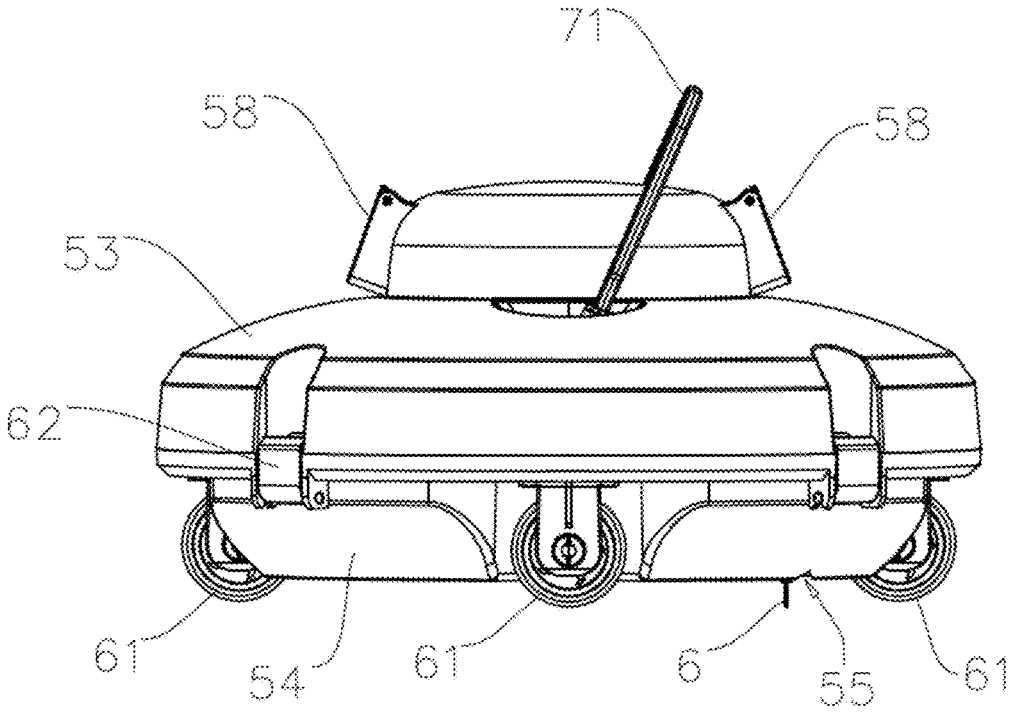
FIG. 2 is a schematic structural diagram of an underwater robot provided in one embodiment of the present application, where a handle is in a second state.
Figure 3:
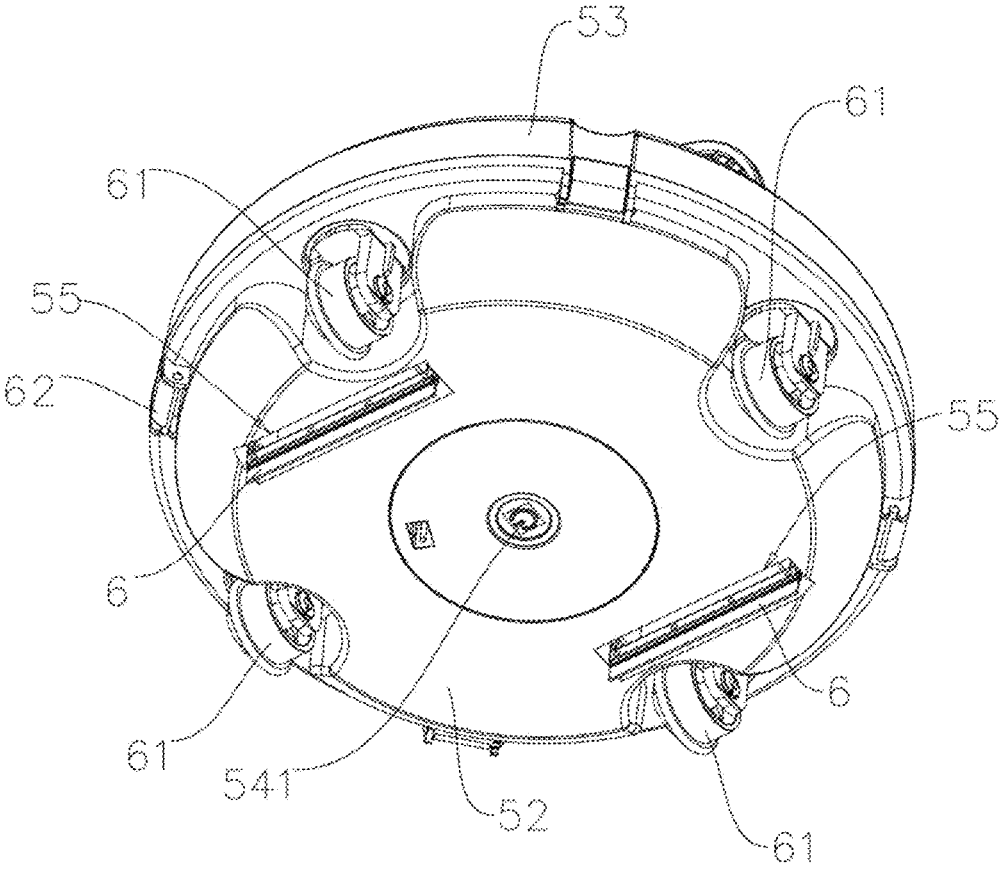
FIG. 3 is a schematic structural diagram of an underwater robot provided in one embodiment of the present application from a bottom angle of view.

As shown in FIG. 1 to FIG. 3, an embodiment of the present application provides an underwater robot. The underwater robot can move autonomously after entering water and perform cleaning under the water. For example, the underwater robot can move autonomously at a bottom of a swimming pool to clean a bottom wall of the swimming pool, which helps to improve the convenience in cleaning the swimming pool.

Exemplarily, the following provides a further description by taking the use of the underwater robot for cleaning the swimming pool as an example.

In an embodiment, a bottom of the underwater robot is provided with a plurality of traveling wheels 61. When the underwater robot is located at the bottom of the swimming pool, the traveling wheels 61 are used to contact and be in rolling connection with the bottom wall of the swimming pool. The arrangement of the traveling wheels 61 helps to not only reduce a frictional force between the underwater robot and the bottom wall of the swimming pool, but also improve the stability of the underwater robot moving at the bottom of the swimming pool.

In an embodiment, the number of the traveling wheels 61 is four. The four traveling wheels 61 are distributed in a cross shape, which helps to improve the movement stability of the underwater robot, and reduce a contact area between the underwater robot and the bottom of the swimming pool, namely, reduce the wear of the bottom of the underwater robot.

In an embodiment, the number of the traveling wheels 61 may also be three, five, or more.

In an embodiment, the traveling wheels 61 are universal wheels, which helps to improve the movement and steering capabilities of the underwater robot.

Figure 4:
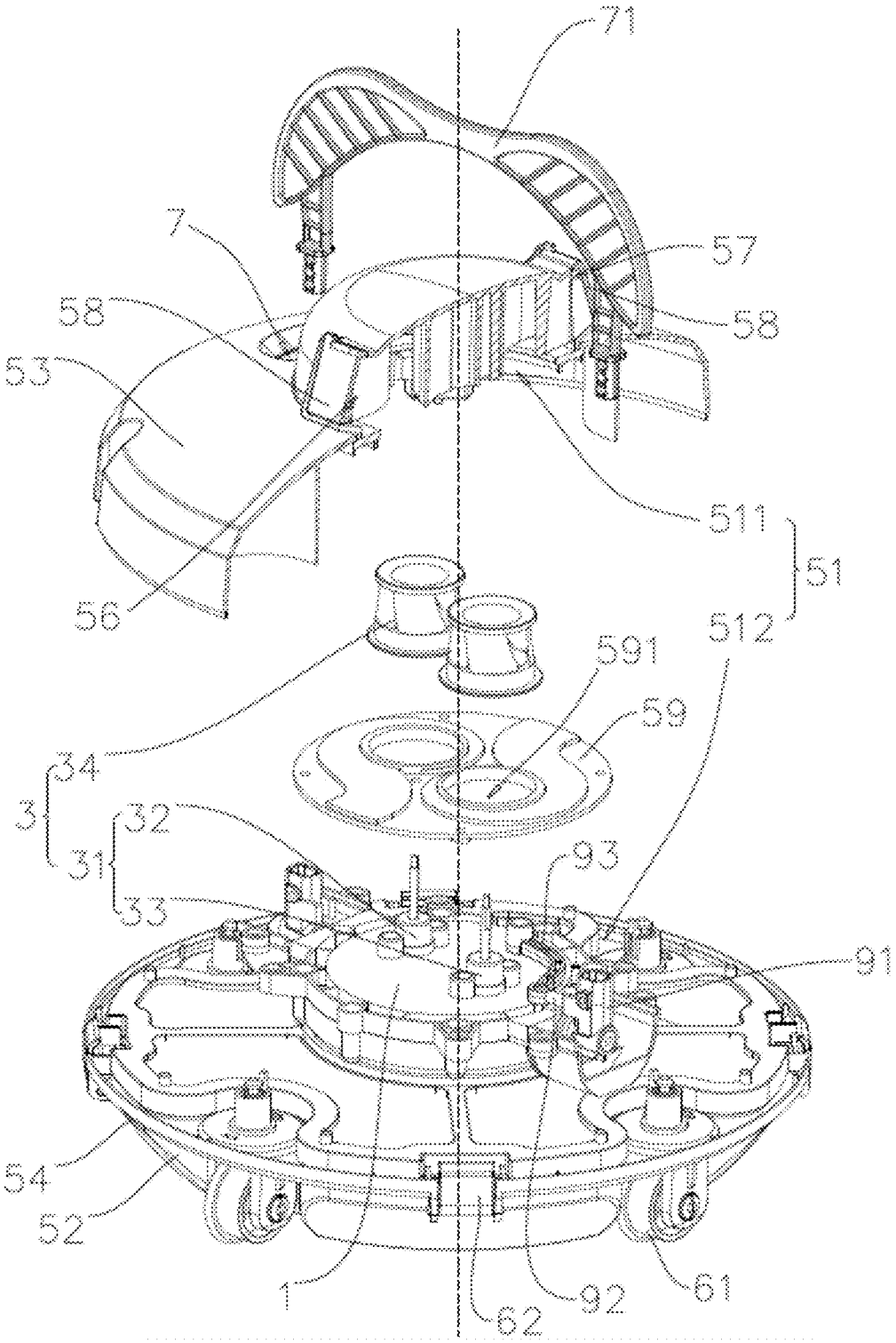
FIG. 4 is a schematic partial exploded view of an underwater robot provided in one embodiment of the present application.
Figure 5:
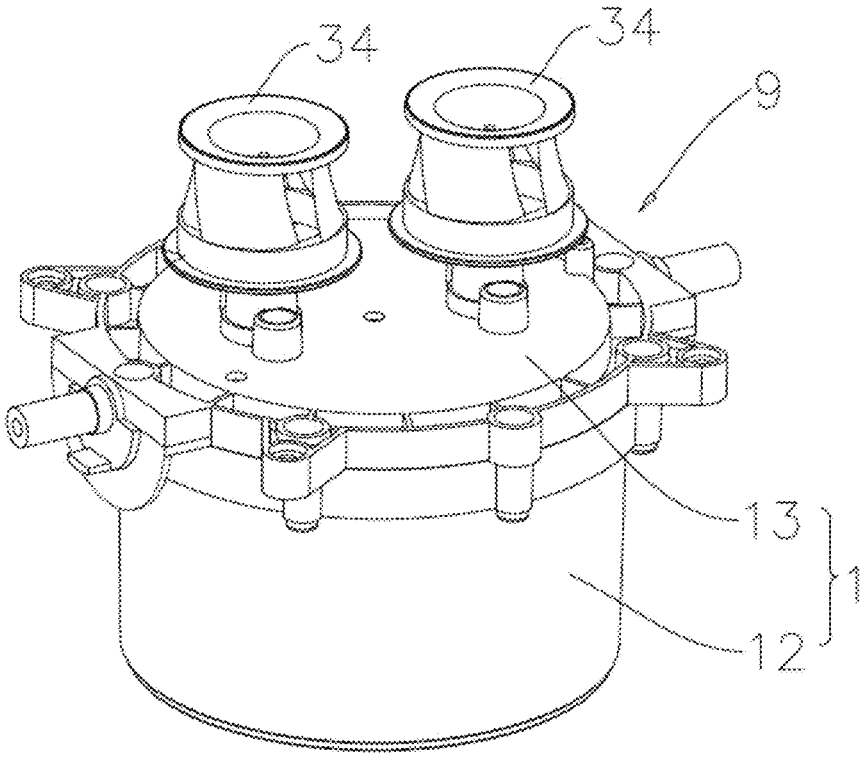
FIG. 5 is a schematic structural diagram of a trigger mechanism provided in one embodiment of the present application.

As shown in FIG. 1, FIG. 4, and FIG. 5, the underwater robot includes a robot body 5 and a trigger mechanism 9, where the trigger mechanism 9 is located in a cavity 51 formed by the robot body 5 and is connected to the robot body 5. When the underwater robot is placed in the swimming pool and is in contact with or immersed in the water, the trigger mechanism 9 can sense a water entry state and then trigger the underwater robot to start to work, so that the underwater robot starts to move under the water and performs cleaning.

In an embodiment, when the underwater robot is in contact with or immersed in the water, the trigger mechanism 9 activates the robot body 5, so that the robot body 5 moves autonomously in the water and starts to clean the bottom of the swimming pool, thereby improving the cleaning efficiency and convenience.

In an embodiment, the robot body 5 includes a housing 52, where the housing 52 is formed with a cavity 51, and the trigger mechanism 9 is located in the cavity 51. The housing 52 can provide protection for the trigger mechanism 9. On the one hand, the trigger mechanism 9 is prevented from being collided by a foreign object, thereby lowering the risk that the trigger mechanism 9 is damaged by collision. On the other hand, the water is prevented from being in contact with the trigger mechanism 9, thereby reducing the influence of the water on the trigger mechanism 9, for example, lowering the risk that the trigger mechanism 9 is rusted or a circuit is damaged due to water contact.

In an embodiment, a projection of the housing 52 on a cross section perpendicular to a vertical direction is approximately circular. When the underwater robot collides with a wall of the swimming pool, a smooth edge of the housing 52 helps to reduce the impact of collision and extend the service life of the underwater robot.

In an embodiment, the housing 52 includes an upper housing 53 and a lower housing 54. The upper housing 53 and the lower housing 54 are mutually connected to form the cavity 51.

In an embodiment, the upper housing 53 and the lower housing 54 are detachably connected to each other in a mutual fastening manner. By lifting a fastening state, the upper housing 53 can be opened to maintain the underwater robot, which helps to improve the convenience in maintenance.

In an embodiment, the robot body 5 includes a plurality of buckles 62, where each buckle 62 is connected to the upper housing 53 and the lower housing 54. The provision of the plurality of buckles 62 helps to improve the reliability and stability of connection between the upper housing 53 and the lower housing 54. In an embodiment, the plurality of buckles 62 are arranged at equal intervals along a circumferential direction of the housing 52, so that various regions of the housing 52 along the circumferential direction keep good stability of connection. In an embodiment, the number of the buckles 62 is four. The four buckles 62 are arranged at equal intervals along the circumferential direction of the housing 52. In other embodiments, the number of the buckles 62 may also be three, five, six, or more.

In an embodiment, taking one of the buckles 62 as an example, the buckle 62 is disposed on the lower housing 54 and is detachably connected to the upper housing 53 in a fastening manner, the buckle 62 is disposed on the upper housing 53 and is detachably connected to the lower housing 54 in a fastening manner, or the buckle 62 is detachably connected to the upper housing 53 and the lower housing 54 in a fastening manner.

Figure 6:
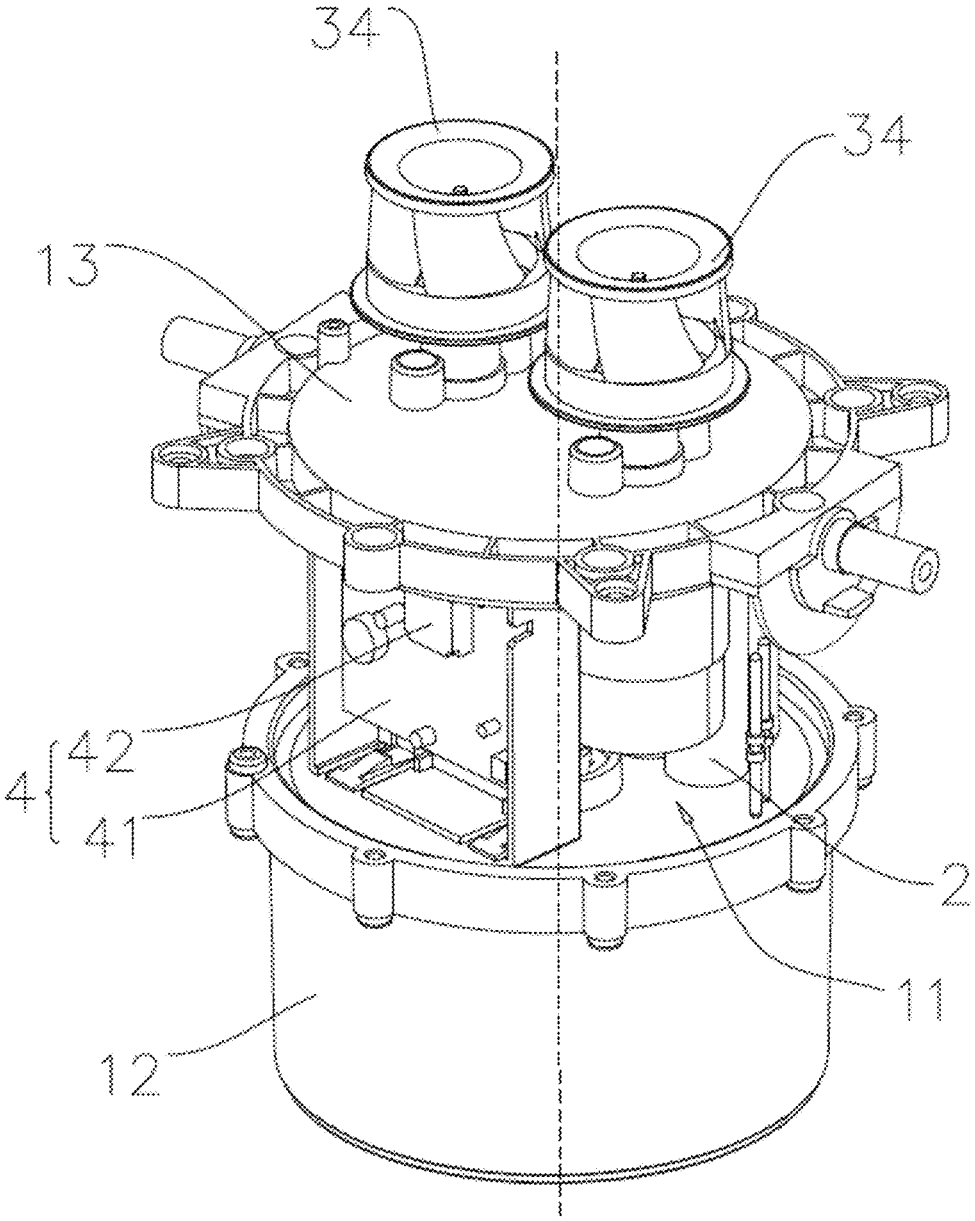
FIG. 6 is an exploded view of a trigger mechanism provided in one embodiment of the present application.

As shown in FIG. 1, FIG. 5, and FIG. 6, in an embodiment, the trigger mechanism 9 includes a sensing structure 4. After the underwater robot enters the water, the sensing structure 4 can sense the water entry state of the underwater robot, thereby triggering the robot body 5 to move and perform cleaning.

In an embodiment, the trigger mechanism 9 further includes a sealed cabin 1, where the sealed cabin 1 is disposed in the cavity 51, a sealed cavity 11 is formed inside the sealed cabin 1, and the sensing structure 4 is disposed in the sealed cavity 11. After the underwater robot enters the water, the housing 52 and the sealed cabin 1 can provide dual protection for the sensing structure 4, thereby lowering the risk of collision damage to the trigger mechanism 9.

In an embodiment, the trigger mechanism 9 further includes a power supply 2, where the power supply 2 is disposed in the sealed cavity 11. After the underwater robot enters the water, the housing 52 and the sealed cabin 1 can provide dual protection for the power supply 2, thereby lowering the risk of damage to the power supply 2 due to contact between the water and the power supply 2.

Further, the power supply 2 is electrically connected to the sensing structure 4, and the power supply 2 can supply power to the sensing structure 4, thereby causing the sensing structure 4 to work normally.

In an embodiment, the trigger mechanism 9 further includes a driving mechanism 3, where one part of the driving mechanism 3 is located in the sealed cavity 11, and another part of the driving mechanism 3 extends out of the sealed cabin 1 and is connected to a workpiece. The driving mechanism 3 is electrically connected to the power supply 2 and the sensing structure 4. When the underwater robot enters the water and the sensing structure 4 senses the water entry state of the underwater robot, the sensing structure 4 triggers the driving mechanism 3 to work, and then the workpiece is driven to move, so that the underwater robot moves and/or performs cleaning.

In an embodiment, the sealed cabin 1 includes a cabin body 12 and a cabin cover 13, where the cabin body 12 and the cabin cover 13 are detachably connected to form the sealed cavity 11. Further, a sealing ring (not shown in figure) is disposed between the cabin body 12 and the cabin cover 13, which helps to ensure the sealing performance of the sealed cavity 11 and lower the risk that external water enters the sealed cavity 11. In an embodiment, the cabin body 12 and the cabin cover 13 can be detachably and fixedly connected by bolts for easy maintenance.

In an embodiment, the power supply 2 includes but is not limited to a storage battery or a dry battery for providing electrical energy.

In an embodiment, the robot body 5 further includes a control switch 541 (as shown in FIG. 3), where the control switch 541 is disposed on the lower housing 54 and electrically connected to the power supply 2, and the control switch 541 is configured to control turn-on and turn-off of the power supply 2. When the underwater robot needs to be used to work in the water, the control switch 541 can be turned on to turn on the power supply 2, and then the underwater robot is placed into the water. In this way, when the underwater robot is stored or transferred on land, the control switch 541 can be turned off to turn off the power supply 2, thereby reducing the electrical energy waste of the power supply 2.

In an embodiment, the control switch 541 may be a physical switch. In an embodiment, the control switch 541 may be a built-in switch triggered by magnetic induction.

In an embodiment, the control switch 541 has a delayed start function. After a user turns on the control switch, the control switch 541 triggers the power supply 2 to be turned on after a set time (e.g., 10 s). In this way, after the user turns on the switch and places the underwater robot into the water, the power supply 2 is triggered to be turned on after 10 s. During this period, the underwater robot can have sufficient time to fall into the bottom of the swimming pool, and then start to move and perform cleaning when located at the bottom of the swimming pool, which helps to lower the risk that the underwater robot starts to move and perform cleaning before being in contact with the bottom. It can be understood that delay time of the control switch 541 can be adjusted appropriately based on a depth of the swimming pool, for example, the delay time of the control switch is set to 20 s or 30 s.

In an embodiment, the sensing structure 4 includes a circuit board 41 and a sensor mounted on the circuit board 41, where the circuit board 41 and the sensor are electrically connected to the power supply 2, and the sensor is configured to sense the water entry state of the underwater robot, such as whether the underwater robot enters the water and a water entry depth.

In an embodiment, the sensor may be a liquid level sensor 42 (e.g., a Hall liquid level sensor 42). The liquid level sensor 42 can check whether the underwater robot enters the water and the water entry depth without being in contact with the water. The liquid level sensor 42 is indirectly connected to the housing 52 or the sealed cabin 1 through other media, and senses the water entry state of the underwater robot by the housing 52 or the sealed cabin 1.

The working principle of the liquid level sensor 42 is as follows: a liquid level of the liquid level sensor 42 in the water (i.e., a liquid level/depth of the underwater robot in the water) is reflected by a change in capacitance of the liquid level sensor 42. Specifically, the liquid level sensor 42 has distributed capacitance, and when there is no liquid approaching the liquid level sensor 42, the liquid level sensor 42 has certain static capacitance to the ground. When there is liquid approaching the liquid level sensor near the liquid level sensor 42 (e.g., there is liquid in contact with the housing 52 or the sealed cabin 1), parasitic capacitance of the liquid is coupled to the static capacitance of the liquid level sensor 42, so that the capacitance of the liquid level sensor 42 changes relative to the static capacitance. Based on the change in the capacitance, the liquid level sensor 42 converts a change in a capacitance signal into a change in an electrical signal. When the change in the electrical signal exceeds a preset change threshold, it can be considered that the liquid level of the underwater robot in the water reaches a preset sensing value. Moreover, the depth of the underwater robot immersed in the water can also be reflected based on different changes in the electrical signal.

In this embodiment, a non-contact liquid level sensor 42 is used to determine the liquid level of the underwater robot in the water. The liquid level sensor 42 does not need to be in direct contact with the water in the pool to determine whether the underwater robot enters the water. Compared with an underwater robot using a contact sensor to detect the liquid level, after the underwater robot leaves the water surface, there will probably be a small amount of residual water on the surface of the sensor, which may lead to false determination of the sensor. In this embodiment, the non-contact liquid level sensor 42 is disposed inside the housing 52. After the underwater robot leaves the water surface, there is only a small amount of residual water on an outer surface of the housing 52 or outside the sealed cabin 1 of the underwater robot, and the small amount of residual water does not cause a change in capacitance of the non-contact liquid level sensor 42 or causes a little change in capacitance, thereby greatly reducing the probability of false determination, and improving the sensing accuracy of the trigger mechanism 9. Moreover, the liquid level sensor 42 in this embodiment is not in direct contact with water, which can reduce or avoid the impact of water contact and extend the service life of the liquid level sensor.

In an embodiment, the liquid level sensor 42 is disposed at a position of the circuit board 41 close to the cabin cover 13. The liquid level sensor 42 is closer to the cabin cover 13 than a bottom of the cabin body 12. In this way, the liquid level sensor 42 can sense the water entry state of the underwater robot based on whether the cabin cover 13 is in contact with the water. The liquid level sensor has high sensitivity. The size of the liquid level sensor 42 can be appropriately reduced on the premise of ensuring the sensing effect of the liquid level sensor, thereby improving the utilization of space in the sealed cabin 1. Additionally, when the underwater robot leaves the water, a top of the underwater robot leaves the water surface first. The cabin cover 13 leaves the water surface before the cabin body 12, that is, the liquid level sensor 42 can leave the water surface earlier and then sense the position of the underwater robot relative to the water surface earlier, so as to trigger disabling of a working state of the robot body 5 earlier, which helps to save electrical energy.

In an embodiment, the number of liquid level sensors 42 may be plural, and the plurality of liquid level sensors 42 are arranged along the vertical direction. Through program setting, work can only be triggered when all the liquid level sensors 42 sense the presence of external water. In this way, the risk of false triggering of the liquid level sensors 42 can be lowered, for example, the underwater robot is falsely triggered due to raining on land or water seepage of the housing 52. In an embodiment, the number of liquid level sensors 42 may be two, and the two liquid level sensors 42 are disposed at two end parts of the circuit board in a vertical direction of the circuit board 41.

In an embodiment, the circuit board 41 may be fixed to the sealed cavity 11 by screws or bolts. In an embodiment, the liquid level sensor 42 may be mounted on the circuit board 41 by means of tin soldering.

In an embodiment, the robot body 5 further includes an alarm device disposed in the sealed cavity 11. The alarm device is configured to provide an alarm prompt after the water enters the sealed cavity 11, which helps to lower the risk that the water enters the sealed cabin 1 due to sealing failure without the user's knowledge, and the risk of damage to the underwater robot.

As shown in FIG. 1 to FIG. 5, in an embodiment, a bottom of the lower housing 54 is provided with at least one water inlet 55 communicating with the cavity 51, and the upper housing 53 is symmetrically provided with a first water outlet 56 and a second water outlet 57 that communicate with the cavity 51 along a front-back direction. When the water in the swimming pool enters the cavity 51 from the water inlet 55, if the water flows out from the first water outlet 56 at a certain speed, power towards the second water outlet 57 is provided for the underwater robot under the action of a reaction force. On the contrary, if the water flows out from the second water outlet 57 at a certain speed, power towards the first water outlet 56 is provided for the underwater robot under the action of the reaction force.

In other embodiments, the upper housing 53 may also be provided with three water outlets (not shown in figure). A connecting line of the three water outlets is in an acute triangle. In this way, by different water outlets for water discharge and water discharge speeds, the underwater robot can move forwards or backwards along any direction, thereby improving the movement capability of the underwater robot.

Exemplarily, the following provides a further description by taking the upper housing 53 only including the first water outlet 56 and the second water outlet 57 as an example.

In an embodiment, part of the structure of the driving mechanism 3 is located in the cavity 51. The driving mechanism 3 can work to drive the water in the cavity 51 to flow out from the first water outlet 56 or the second water outlet 57, thereby controlling forward and backward movement of the underwater robot. Moreover, the driving mechanism 3 can also control a movement speed of the underwater robot by controlling the speed at which the water flows out from the first water outlet 56 or the second water outlet 57.

In an embodiment, the driving mechanism 3 includes motors 31 and impellers 34. There are two motors 31, and a main body of each motor 31 is located in the sealed cabin 1. An output shaft of each motor 31 hermetically extends out of the sealed cabin 1 from the cabin cover 13. There are two impellers 34, and the two impellers 34 are correspondingly connected to the output shafts of the two motors 31, that is, one impeller 34 is mounted on the output shaft of one motor 31. The two motors 31 are both electrically connected to the power supply 2 and the sensing structure 4. After the sensing structure 4 senses that the underwater robot entering the water, the corresponding motor 31 is triggered to work and then drives the corresponding impeller 34 to rotate, so as to control a direction and a flow velocity of a water flow.

In this embodiment, for ease of distinction, the two motors 31 include a first motor 32 and a second motor 33, and the two impellers 34 are mounted on the first motor 32 and the second motor 33 respectively. The first motor 32 corresponds to the first water outlet 56, and the first motor 32 works to drive the water flow to flow out from the first water outlet 56. The second motor 33 corresponds to the second water outlet 57, and the second motor 33 works to drive the water flow to flow out from the second water outlet 57.

In this embodiment, a sealing structure (e.g., a sealing ring) is disposed between the output shaft of each motor 31 and the cabin cover 13 to ensure the sealing performance of the sealed cavity 11.

In an embodiment, both the first water outlet 56 and the second water outlet 57 are provided with cover plates 58, and the cover plates 58 are rotatably connected to the upper housing 53 and can rotate outwards to be opened.

Taking the first water outlet 56 as an example, in a state where the underwater robot does not work or does not need to move, the first motor 32 is in a non-working state, the cover plate 58 at the first water outlet 56 covers the first water outlet 56 in a naturally falling manner to shield the first water outlet 56, which can prevent external sundries from entering the housing 52 through the first water outlet 56. After the underwater robot enters the water and triggers the first motor 32 to work, the water flow flows out from the first water outlet 56 and acts on the cover plate 58 at the first water outlet 56 to jack up the cover plate 58, so that the first water outlet 56 communicates with the inside and outside and is in an opened state, and the water flow can flow out from the first water outlet 56. It can be understood that different motors 31 in the driving mechanism 3 work to ensure that the water flow flows towards different water outlets, then jacks up the corresponding cover plates 58, and finally flows out from the corresponding water outlets.

It is to be noted that the cover plates 58 may be manufactured by mounting counterweight blocks or from high-density materials, or mechanical mechanisms with elastic reset functions such as torsion springs are used, so that even if the cover plates 58 are subjected to buoyancy of the water, the cover plates can still shield the water outlets under their own gravity, which is not elaborated too much in the present application.

In an embodiment, the robot body 5 further includes a baffle 59, where the baffle 59 is located in the cavity 51 and divides the cavity 51 into an upper cavity 511 and a lower cavity 512. The first water outlet 56 and the second water outlet 57 both communicate with the upper cavity 511, and the water inlet 55 in the bottom communicates with the lower cavity 512.

Moreover, the baffle 59 is provided with two through holes 591, where the two through holes 591 directly face the two impellers 34 along the vertical direction respectively. The output shaft of the first motor 32 passes through one through hole 591, and the output shaft of the second motor 33 passes through the other through hole. In this way, the water flow enters the upper cavity 511 from the lower cavity 512 by the impellers 34. In addition, a solid structure on the baffle 59 other than the through holes 591 also plays a blocking role, so that the water in the lower cavity 512 can only enter the upper cavity 511 from the through hole 591 to increase the velocity of the water flow passing through the through hole 591, thereby increasing the velocity at which the water flow flows out from the first water outlet 56 or the second water outlet 57, increasing the movement speed of the underwater robot, and improving the movement stability of the underwater robot. In an embodiment, the impellers 34 may also be disposed in the through holes 591.

In this embodiment, the baffle 59 may be detachably connected into the cavity 51 by screws or bolts.

In an embodiment, after the underwater robot is immersed in the swimming pool, the water triggers the liquid level sensor 42, so that the first motor 32 is started. The output shaft of the first motor 32 drives the corresponding impeller 34 to rotate, so that the water in the lower cavity 512 enters the upper cavity 511 through the through hole 591 and the impeller 34 in sequence. Then, the cover plate 58 on the first water outlet 56 is pushed under the stirring effect of the impeller 34, so that the first water outlet 56 is opened. At this time, the water in the lower cavity 512 is continuously pushed out from the first water outlet 56, thereby driving the underwater robot to move. It is to be noted that at this time, the cover plate 58 on the second water outlet 57 is still in a state of shielding the second water outlet 57.

In an embodiment, a bottom of the robot body 5 is further provided with a scraper plate 6, and the scraper plate 6 is rotatably disposed at the water inlet 55 in the bottom of the lower housing 54. When the underwater robot falls to the bottom of the swimming pool, the scraper plate 6 is in contact connection with the bottom wall of the swimming pool. When the underwater robot moves at the bottom of the swimming pool, the scraper plate 6 can scrape up garbage or sundries on the bottom wall of the swimming pool and guide them to the water inlet 55, so that the water flow passing through the water inlet 55 brings the garbage or sundries into the robot body 5.

In an embodiment, the scraper plate 6 has one end rotatably connected to an inner side of the water inlet 55, and the other end extending obliquely downward from the water inlet 55. Specifically, an inclination direction of the scraper plate 6 extending out from the water inlet 55 is opposite to an advancing direction of the underwater robot, which helps to reduce a frictional force between the scraper plate 6 and the bottom of the swimming pool, and decrease resistance of the scraper plate 6 cleaning the bottom wall of the swimming pool to the movement of the underwater robot.

In an embodiment, the robot body 5 further includes a baffle 59, where the baffle 59 is rotatably disposed inside the water inlet 55. When the underwater robot is on land or in the non-working state, the baffle 59 can close the water inlet 55 under its own gravity, thereby lowering the risk that external sundries enter the housing 52 through the water inlet 55. When the underwater robot is immersed in the water, the density of the baffle 59 makes it rotate under the buoyancy of the water to open the water inlet 55, thereby reducing its impact on the water flow.

In an embodiment, the number of scraper plates 6 is equal to the number of water inlets 55, and each scraper plate 6 is disposed at the corresponding water inlet 55.

In an embodiment, the number of baffles 59 is equal to the number of water inlets 55, and each baffle 59 is disposed at the corresponding water inlet 55.

As shown in FIG. 1, FIG. 2, FIG. 4, and FIG. 7 to FIG. 9, in an embodiment, the robot body 5 further includes a handle 71 and a reset structure 8, where the reset structure 8 and the trigger mechanism 9 are both connected to the handle 71.

Part of the structure of the handle 71 is rotatably connected into the cavity 51, and part of the structure of the handle 71 penetrates through the upper housing 53 in a manner of extending outwards. The handle 71 can be held by the user to lift and pull the underwater robot, and when the underwater robot is located in the swimming pool, the handle 71 can also be provided for the user to use other tools to hook and pull the underwater robot out of the water.

The handle 71 has a first state and a second state. When the handle 71 is in a first state (an initial state), the handle 71 is roughly in an upright state. When the handle 71 is in a second state, the handle 71 rotates a certain angle relative to the first state, and forms an included angle with the vertical direction.

The reset structure 8 is further connected to the housing 52. When the handle 71 is not subjected to external resistance or when the robot body 5 is stationary in the pool (e.g., the advancing direction is blocked by a sidewall of the swimming pool), the reset structure 8 is used to reset the handle 71, causing the handle 71 to rotate from the second state to the first state.

When the underwater robot moves in the water, the handle 71 is subjected to resistance of the water and then rotates along a direction opposite to the advancing direction of the underwater robot, that is, the underwater robot moves forwards, and the handle 71 is inclined backwards, thereby squeezing the reset structure 8 and triggering the trigger mechanism 9. At this time, the reset structure 8 transitions from a normal compression state to a squeezing state. During normal advancing of the underwater robot, if the underwater robot encounters a foreign object such as a wall, the underwater robot is blocked by the wall and stops advancing. At this time, the resistance of the water on the handle 71 and a squeezing force of the handle 71 on the reset structure 8 disappear or decrease, the reset structure 8 resets from the squeezing state, and the handle 71 is driven to reset to the initial state. At this time, the trigger mechanism 9 controls the robot body 5 to move in the opposite direction.

In an embodiment, the upper housing 53 is symmetrically provided with two avoidance holes 7 along a transverse direction, one end of the handle 71 extends into the cavity 51 through one avoidance hole 7, the other end of the handle 71 extends into the cavity 51 through the other avoidance hole 7, and a part of the handle 71 between two ends is located above the upper housing 53 and is spaced apart from the upper housing 53, thereby forming a connecting part that can be held or lifted and pulled by the user. This embodiment is beneficial for lifting and pulling the underwater robot by the handle 71 and reducing resistance generated by the handle 71 when the underwater robot moves in the water.

In an embodiment, the reset structure 8 is an elastic structure. Further, the reset structure 8 may be a torsion spring that can be connected to the cabin body 12 or the housing 52 and the handle 71. When the handle 71 rotates from the first state, the torsion spring is compressed and deformed, and its elastic restoring force has a tendency to drive the handle 71 to restore to the first state. In this embodiment, the torsion spring is used as the reset structure 8, which can effectively extend the service life of the reset structure 8.

Figure 7:
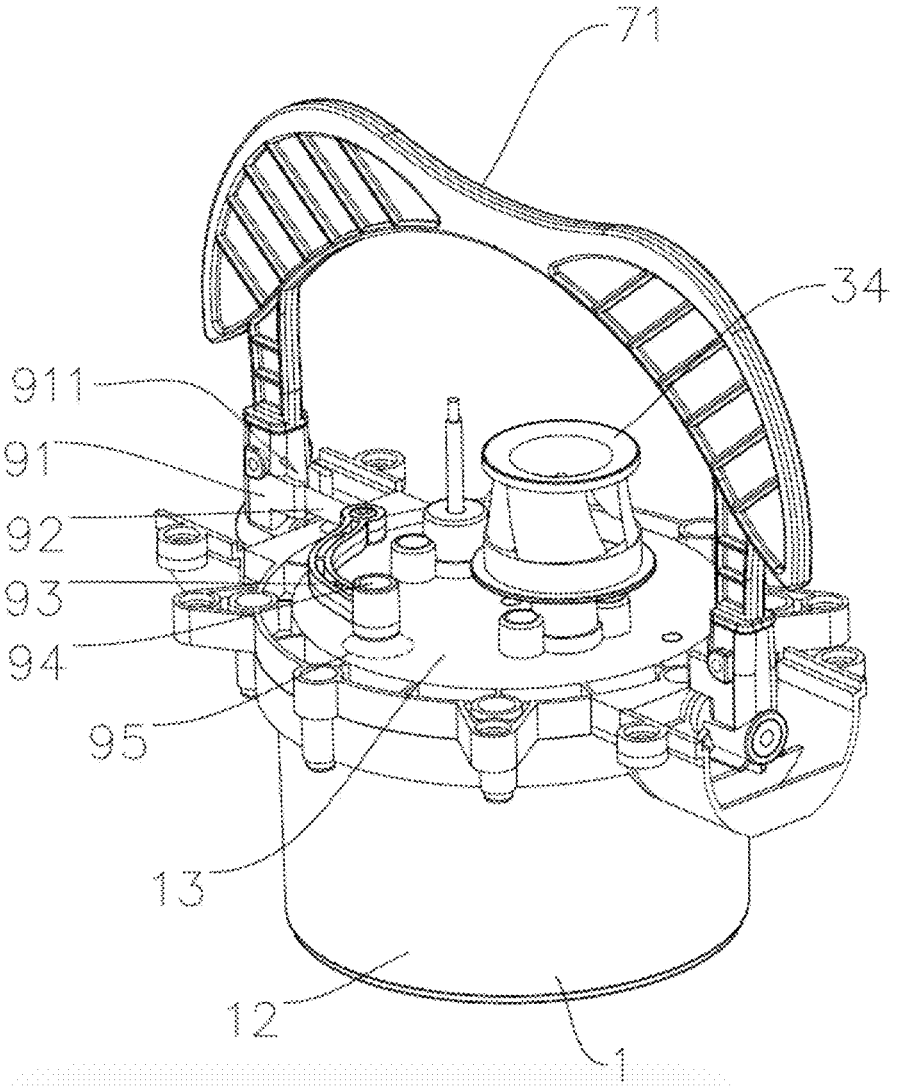
FIG. 7 is a schematic diagram of a partial structure of an underwater robot provided in one embodiment of the present application.
Figure 8:
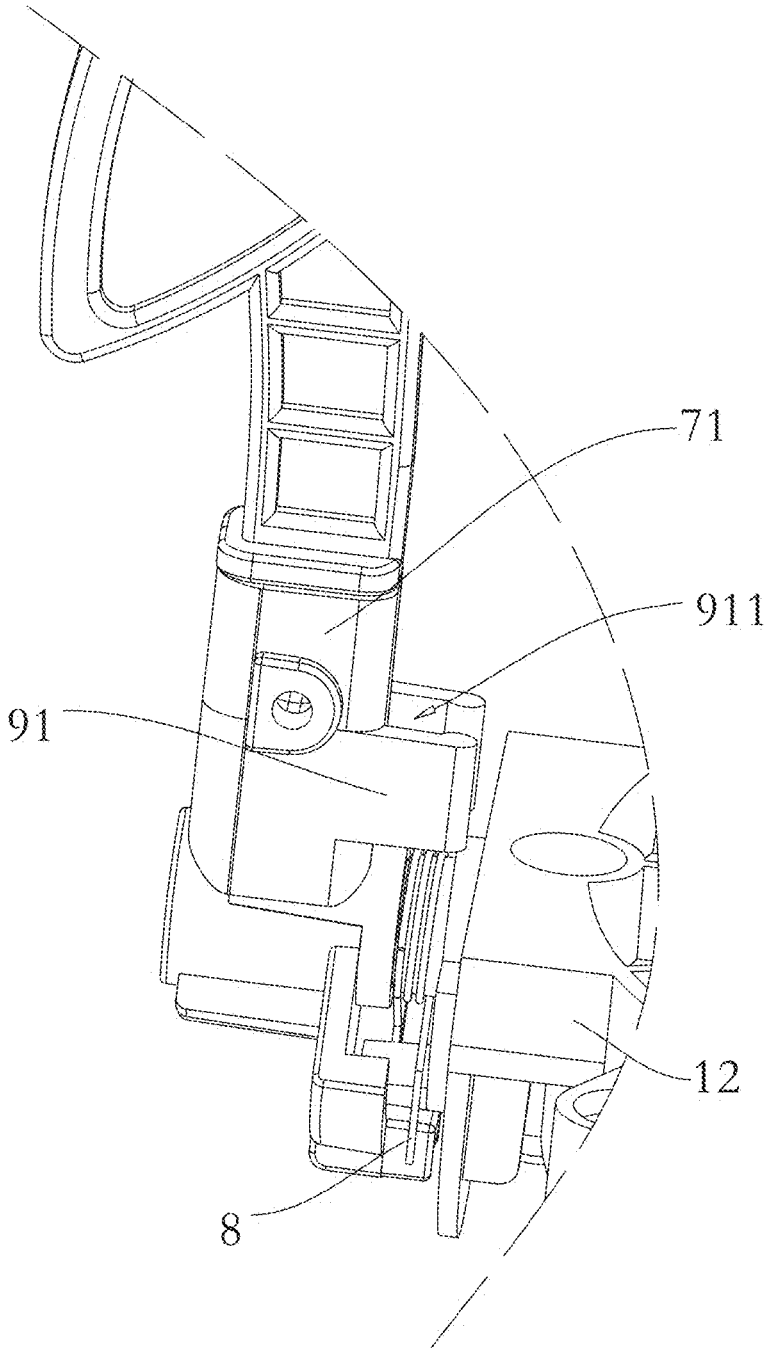
FIG. 8 is a schematic diagram of a partial structure of a reset structure in an underwater robot provided in one embodiment of the present application.
Figure 9:
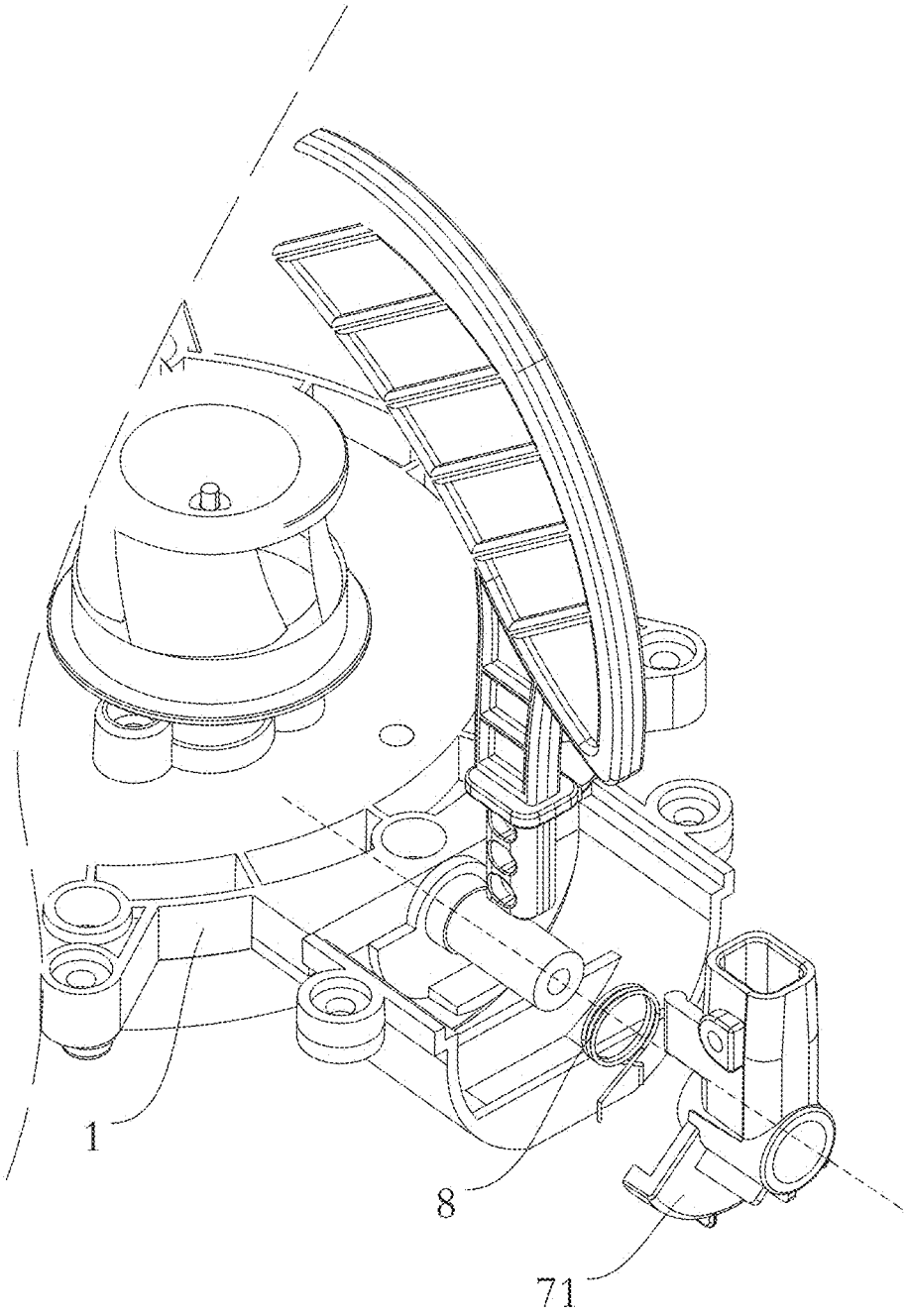
FIG. 9 is an exploded view of a partial structure of an underwater robot provided in one embodiment of the present application.

In an embodiment, the trigger mechanism 9 includes a first connecting rod 92, a second connecting rod 93, a Hall sensor (not shown in figure), and a magnet 94. The first connecting rod 92 is connected to the handle 71 and the second connecting rod 93, and a joint between the second connecting rod 93 and the first connecting rod 92 is rotatably connected to the sealed cabin 1. The Hall sensor is mounted in the sealed cavity 11 and is electrically connected to the driving mechanism 3 by the circuit board 41, and a certain motor 31 can be driven by the circuit board 41 to work. The magnet 94 is connected to a free end of the second connecting rod 93 away from the first connecting rod 92. The handle 71 is capable of rotating to drive the first connecting rod 92 to rotate, the first connecting rod 92 drives the second connecting rod 93 to rotate, and the free end of the second connecting rod 93 drives the magnet 94, so that the magnet 94 is moved out from a sensing region 95 (as shown in FIG. 7) of the Hall sensor or into the sensing region 95 of the Hall sensor from outside the sensing region 95 of the Hall sensor.

In an embodiment, the first connecting rod 92 and the second connecting rod 93 may be of an integrated structure, which helps to reduce the number of parts, and facilitates assembly and maintenance. In an embodiment, the first connecting rod 92 and the second connecting rod 93 are two separate structures, which helps to lower the difficulty in machining the parts and reduce manufacturing costs of the parts.

Further, when the handle 71 is in a vertical state (i.e., the first state), the magnet 94 is located in the sensing region 95 of the Hall sensor. When the robot body 5 is in a moving state, the handle 71 is in an inclined state (i.e., the second state), the magnet 94 moves outside the sensing region 95 of the Hall sensor. When the underwater robot transitions from the moving state to a stationary state (e.g., of being blocked by the sidewall of the swimming pool) in the water, the handle 71 resets from the second state to the first state, and the magnet 94 moves to the sensing region 95 of the Hall sensor, so that the Hall sensor is triggered to drive the motor 31 in working to stop rotating and drive the other motor 31 to start to rotate, thereby causing the underwater robot to move in the opposite direction.

In an embodiment, the first connecting rod 92 and the second connecting rod 93 are arranged and rotated along the transverse direction, which helps to make full use of transverse space in the housing 52, reduce the impact of the trigger mechanism 9 on vertical space in the robot body 5, improve the space utilization of an internal structure of the underwater robot, and decrease the vertical height of the underwater robot, thereby improving the movement stability of the underwater robot.

In an embodiment, the trigger mechanism 9 further includes a connecting base 91, where the connecting base 91 is connected to the handle 71, and the connecting base 91 can rotate synchronously with the handle 71. Moreover, during rotation of the connecting base 91 with the handle 71, the connecting base 91 is further configured to drive the first connecting rod 92 to rotate.

In an embodiment, the connecting base 91 is provided with a connecting groove 911, and part of the structure of the first connecting rod 92 is located in the connecting groove 911. When the handle 71 rotates relative to the housing 52, the connecting base 91 also rotates relative to the housing 52, so that the connecting base is in contact with the first connecting rod 92 through a sidewall of the connecting groove 911 to drive the first connecting rod 92 to rotate. Further, the first connecting rod 92 drives the second connecting rod 93 to rotate, and the free end of the second connecting rod 93 drives the magnet 94 to move for triggering the Hall sensor or leaving the sensing region 95 of the Hall sensor.

In specific application scenarios, the control switch 541 of the underwater robot is turned on, and the handle 71 is in the vertical state, that is, the magnet 94 is located in a triggering region of the Hall sensor. When the underwater robot is placed in the water, the liquid level sensor 42 is triggered, and the first motor 32 is started, thereby starting the underwater robot.

In an embodiment, the Hall sensor and the liquid level sensor 42 are connected in series. When the underwater robot performs cleaning under the water, the handle 71 is in the inclined state (the second state) due to the resistance of the water. At this time, the magnet 94 at the free end of the second connecting rod 93 is far away from the sensing region 95 of the Hall sensor. When the underwater robot stops advancing due to the resistance, the handle 71 is reset under the elastic restoring effect of the reset structure 8. At this time, the magnet 94 at the free end of the second connecting rod 93 rotates to the initial position, that is, the magnet 94 is reset to the sensing region 95 of the Hall sensor. At this time, the Hall sensor is triggered, the first motor 32 that rotates currently is controlled by the circuit board 41 to stop running, and the second motor 33 is controlled to be started to change the direction of the water flow, so that the underwater robot moves in the opposite direction, thereby implementing full-coverage cleaning on the bottom of the pool.

It is to be noted that the present application does not specifically limit the size of the triggering region of the Hall sensor, and the corresponding type of Hall sensor can be selected based on a movement distance of the magnet 94.

The above descriptions are only specific embodiments of the present application, but the scope of protection of the present application is not limited thereto. Any of those skilled in the art may easily think of various equivalent modifications or substitutions within the technical scope of the present application, and these modifications or substitutions should all be included within the scope of protection of the present application. Therefore, the scope of protection of the present application should be subject to the scope of protection of the claims.

What is claimed is:

1. An underwater robot, comprising a robot body and a trigger mechanism, wherein the robot body comprises a housing, and the trigger mechanism is disposed in the housing; and the trigger mechanism comprises:

a sealed cabin, provided with a sealed cavity and disposed in the housing, wherein the sealed cavity is sealed;

a driving mechanism, wherein at least a part of a structure of the driving mechanism is located in a region between the sealed cabin and the housing; and a sensing structure, disposed in the sealed cavity and electrically connected to the driving mechanism;

wherein the housing comprises a cavity, and the trigger mechanism is located in the cavity;

the housing is provided with a water inlet, a first water outlet and a second water outlet; the water inlet, the first water outlet and the second water outlet are communicated with the cavity; and the first water outlet and the second water outlet are formed in two ends of the housing along a front-back direction respectively;

after the underwater robot is immersed in water, the water inlet is configured to allow the water flow in; and the driving mechanism is configured to drive the water in the cavity to flow out from the first water outlet or the second water outlet.

2. The underwater robot according to claim 1, wherein the sensing structure comprises liquid level sensors that are disposed in the sealed cavity.

3. The underwater robot according to claim 2, wherein the liquid level sensors are closer to a top of the sealed cabin than a bottom of the sealed cabin.

4. The underwater robot according to claim 2, wherein the liquid level sensors are arranged along a vertical direction.

5. The underwater robot according to claim 1, wherein the driving mechanism comprises:

two motors, both of the motors are electrically connected to the sensing structure, wherein an output shaft of each of the motors is hermetically extended out of the sealed cabin; and two impellers, both of the two motors are disposed in the region between the sealed cabin and the housing, wherein one of the impellers is connected to the output shaft of one of the motors, and the other impeller is connected to the output shaft of the other motor; and after the underwater robot enters the water and triggers the sensing structure, the sensing structure is configured to trigger one of the motors to work and drive the corresponding impeller to rotate, so that the water in the cavity flows out from the first water outlet or the second water outlet.

6. The underwater robot according to claim 5, wherein the robot body further comprises a baffle, the baffle is disposed in the cavity, and the cavity is divided into an upper cavity and a lower cavity, wherein the upper cavity is communicated with the first water outlet and the second water outlet, and the lower cavity is communicated with the water inlet; and the baffle is provided with two through holes communicating with the upper cavity and the lower cavity, one of the through holes is opposite to one of the impellers along a vertical direction, and the other through hole is opposite to the other impeller along the vertical direction.

7. The underwater robot according to claim 5, wherein the robot body further comprises a scraper plate, the scraper plate is rotatably connected to the housing, and at least a part of a structure of the scraper plate is extended downward from the water inlet; and the scraper plate is configured to scrape up garbage or sundries located below the underwater robot.

8. The underwater robot according to claim 7, wherein when the underwater robot moves and performs cleaning, a direction in which the scraper plate extends out from the water inlet is opposite to an advancing direction of the underwater robot.

9. The underwater robot according to claim 1, wherein the robot body further comprises a handle, and a part of a structure of the handle is rotatably connected to the housing or the sealed cabin and penetrates through an upper end part of the housing in a manner of extending outwards;

the handle comprises a first state and a second state;

when in the first state, the handle is approximately in an upright state; and when in the second state, the handle is inclined relative to the housing.

10. The underwater robot according to claim 9, wherein the robot body further comprises a reset structure, the reset structure is connected to the handle and configured to rotate the handle from the second state to the first state.

11. The underwater robot according to claim 10, wherein the trigger mechanism comprises:

a first connecting rod connected to the handle;

a second connecting rod connected to the first connecting rod, wherein a connecting region between the second connecting rod and the first connecting rod is rotatably connected to the sealed cabin;

a Hall sensor disposed in the sealed cavity, electrically connected to the driving mechanism, and configured to drive both of the motors of the driving mechanism to work; and a magnet connected to an end part of the second connecting rod away from the connecting region; and when rotating relative to the housing, the handle is configured to connect to the first connecting rod and drive the first connecting rod to rotate, the first connecting rod is configured to drive the second connecting rod to rotate, and the second connecting rod is configured to drive the magnet to rotate, leading the magnet moves into or out of a sensing region of the Hall sensor.

12. The underwater robot according to claim 11, wherein when the handle is in the first state, the magnet is located in the sensing region of the Hall sensor; and when the handle is in the second state, the magnet is located outside the sensing region of the Hall sensor.

13. The underwater robot according to claim 11, wherein the trigger mechanism further comprises a connecting base, the connecting base is connected to the handle and provided with a connecting groove, and a part of a structure of the first connecting rod is located in the connecting groove; and the handle is configured to drive the connecting base to rotate, and during a rotation of the connecting base, a sidewall of the connecting groove is connected to the first connecting rod, thereby causing the first connecting rod to rotate.

14. The underwater robot according to claim 10, wherein the reset structure comprises a torsion spring.

15. The underwater robot according to claim 1, wherein the robot body further comprises a plurality of traveling wheels disposed at a bottom of the housing.

16. The underwater robot according to claim 1, wherein the robot body further comprises two cover plates both rotatably connected to the housing, the two cover plates are configured to cover the first water outlet and the second water outlet;

when the driving mechanism drives a water flow to flow towards the first water outlet, the cover plate covering the first water outlet is jacked up, and the water flows out from the first water outlet; and when the driving mechanism drives the water flow to flow towards the second water outlet, the cover plate covering the second water outlet is jacked up, and the water flows out from the second water outlet.

* * * * *